US006650217B1

(12) United States Patent
Wolf et al.

(10) Patent No.: US 6,650,217 B1
(45) Date of Patent: Nov. 18, 2003

(54) LOW PROFILE MAGNETIC COMPONENT WITH PLANAR WINDING STRUCTURE HAVING REDUCED CONDUCTOR LOSS

(75) Inventors: Ronald M. Wolf, Katonah, NY (US); Glenn R. Skutt, Blacksburg, VA (US); Liming Ye, Blacksburg, VA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 1164 days.

(21) Appl. No.: 08/813,132

(22) Filed: Mar. 7, 1997

(51) Int. Cl.[7] ..... H01F 17/06
(52) U.S. Cl. ..... 336/178; 336/200; 336/223
(58) Field of Search ..... 336/178, 200, 336/223, 190, 232, 231, 233, 222

(56) References Cited

U.S. PATENT DOCUMENTS

| | | | | | |
|---|---|---|---|---|---|
| 4,224,500 | A | * | 9/1980 | Cruickshank et al. | 336/178 |
| 4,480,377 | A | * | 11/1984 | House et al. | 336/178 |
| 5,010,314 | A | * | 4/1991 | Estrow | 336/198 |
| 5,025,241 | A | * | 6/1991 | Bouillot et al. | 336/178 |
| 5,175,525 | A | * | 12/1992 | Smith | 336/83 |
| 5,359,313 | A | * | 10/1994 | Wantanabe | 336/178 |

* cited by examiner

*Primary Examiner*—Anh Mai

(57) ABSTRACT

A planar magnetic winding structure such as a transformer or inductor having an air gap in the core has a "keep away" region of 2 to 3 times the gap height in which there are no windings, reducing high frequency winding losses by 35 percent or more, without appreciable increases in low frequency winding losses. Such structures are useful, for example, in electronic ballasts for the lighting industry.

13 Claims, 5 Drawing Sheets

LOW PROFILE MAGNETIC COMPONENT WITH PLANAR WINDING STRUCTURE HAVING REDUCED CONDUCTOR LOSS

BACKGROUND OF THE INVENTION

This invention relates to low profile magnetic components, and more particularly relates to such components including planar magnetic winding structures, such as inductors and transformers, in which the windings are composed of stacks of interconnected layers of conductor patterns.

The trend toward miniaturization in power electronics requires high power density and low profile magnetic components, which in most cases are the bulkiest circuit components. Reducing the size of such components requires higher drive frequencies, in order to obtain the same performance as a larger magnetic component. All of these factors of smaller size, higher power density and higher operating frequency lead to considerably increased heat generation. As the size of such components decreases, the available surface area through which the heat can be guided towards the environment decreases rapidly, while the total losses remain about the same.

Planar winding structures consist of a stack of layers each containing part of the total winding structure, an insulating layer used to prevent electrical contact between the turns in adjacent layers, usually consisting of a flexible, non-conducting, low permittivity, high temperature resistant polymer, and a contacting structure that permits electrical contact between turns in adjacent layers where needed. The winding structures are optimized with respect to winding losses, and are usually made by etching or stamping or sometimes by folding. Contacts are usually made by soldering or via plating.

The use of such magnetic components is always accompanied by dissapative losses in the core and windings. Such losses decrease the efficiency of the magnetic component and the electronic circuit of which it is a part, and increase the temperature of the component and the surrounding area, changing the electrical characteristics and reducing the lifetime of the component and other components in thermal contact with it.

In general, winding losses are due to the interaction of the winding current with a local magnetic field, due largely to leakage flux from the windings and to stray fields near the gaps in the core. The leakage flux is largely determined by the dimensions of the winding structure and is more or less evenly distributed over the winding window. However, the stray fields near the gap are local in nature and can give rise to large local increases in winding losses. In addition, such local losses will give rise to local thermal runaway phenomena, so called "hot spots".

In planar winding structures, air gaps which induce fringing fields can form a significant portion of the core window height. High frequency magnetic field components in the winding current then induce large eddy currents in the conductors near the air gaps, and as a result, current crowds toward the edges of these conductors. The eddy currents are most severe for the conductors adjacent to the gaps because the fringing fields are strongest in these regions, and therefore it is preferred to locate the windings as far away from the gaps as possible.

The one-dimensional analytical loss equations popularly used for calculating high frequency losses in ungapped transformer designs do not adequately predict the winding losses of a gapped structure due to the presence of these air gaps.

It is difficult to minimize these gap-related losses using traditional wire wound construction techniques, since it is difficult to achieve the desired separation between air gaps and windings in a reproducible way.

Increasing the spacing between the windings and the air gaps inevitably decreases the cross-sectional area available for the winding in a fixed core geometry. This reduction in winding area increases the DC resistance of the coil, and depending on the balance of low-frequency and high-frequency currents in the core, the benefits of reducing high-frequency losses by avoiding the keep-away regions may be offset by increased DC losses.

OBJECTS AND SUMMARY OF THE INVENTION

Accordingly, it is an object of the invention to provide a low profile magnetic component with a planar magnetic winding structure, having reduced winding losses.

It is another object of the invention to provide such a component containing air gaps in the core, having reduced winding losses.

According to the invention, there is provided a planar magnetic winding structure comprising a core of two or more core components having mutually facing planar surfaces separated by at least one air gap having a height g, and a stack of winding layers, each layer including one or more turns, in which structure the edges of the windings are separated from the air gap by a distance of at least 2g, and preferably by a distance of at least 3g.

According to one embodiment of the invention, the core of the planar magnetic winding structure comprises a first lower core component having a planar portion and two or more spaced-apart upstanding portions having planar upper surfaces, the upstanding portions defining a space to accommodate the stack of winding layers, the core also comprising. a second upper core component having a planar lower surface, the planar upper surfaces of the upstanding portions of the first core component and the planar lower surface of the second core component defining the air gap g.

Preferably, the stack of winding layers in the space between the upstanding portions of the lower core component comprises two or more sub-stacks, each sub-stack having the same number of turns in each layer, the sub-stacks proximal to the air gap g having a smaller number of windings per layer than the sub-stacks distal from the air gap g.

Most preferably, the number of turns per layer in each successive sub-stack from the most distal sub-stack to the most proximal sub-stack is smaller than the number of turns per layer in the preceding sub-stack.

A planar magnetic winding structure in accordance with the invention, such as a transformer or inductor, having an air gap in the core with a "keep away" region of 2 to 3 times the gap height in which there are no windings, reduces high frequency winding losses by 35 percent or more, without appreciable increases in low frequency winding losses. Such structures are useful, for example, in electronic ballasts for the lighting industry.

BRIEF DESCRIPTION OF THE DRAWING

FIGS. 4 is a bar graph of relative inductor winding losses in percent versus frequency in kHz for the planar transformer constructions of. FIGS. 2*a* and 2*c*.

DETAILED DESCRIPTION OF THE INVENTION

Figure 1A:
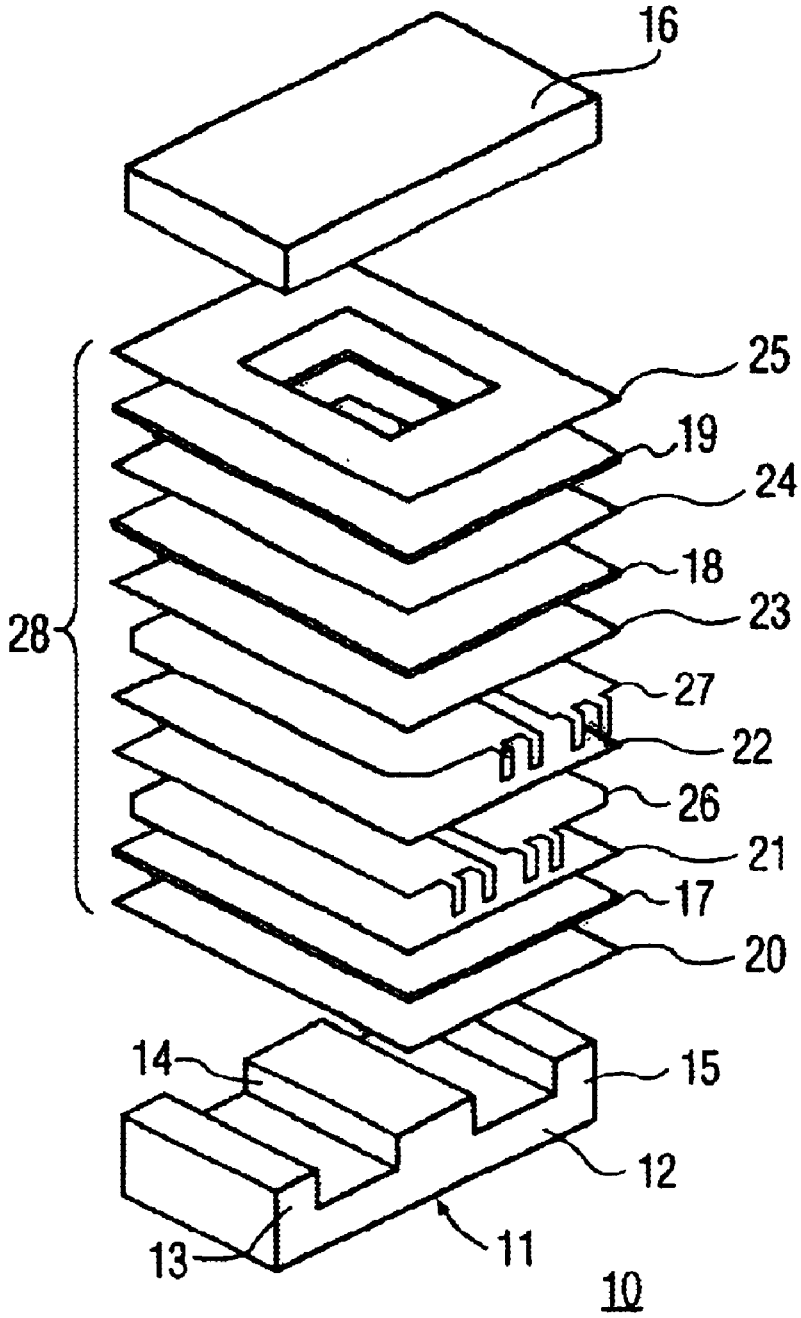
FIG. 1a (PRIOR ART)
FIGS. 1*a*, 1*b* and 1*c* are an expanded perspective view, a top view and a side view, respectively, of a schematic representation of a planar transformer construction of the prior art.

The invention will now be further elucidated by a detailed description of certain preferred embodiments of the invention, in conjunction with the drawings, in which the same reference numerals are used to indicate similar features or elements in different figures.

Figure 1C:
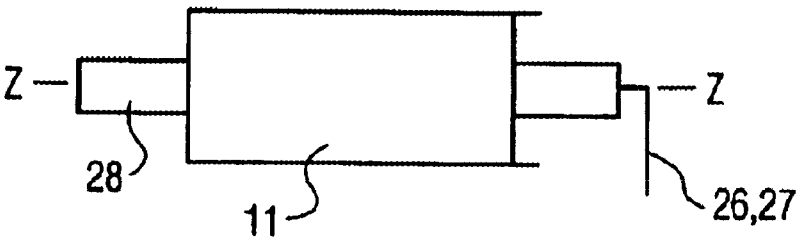
FIG. 1c (PRIOR ART)
Figure 1B:
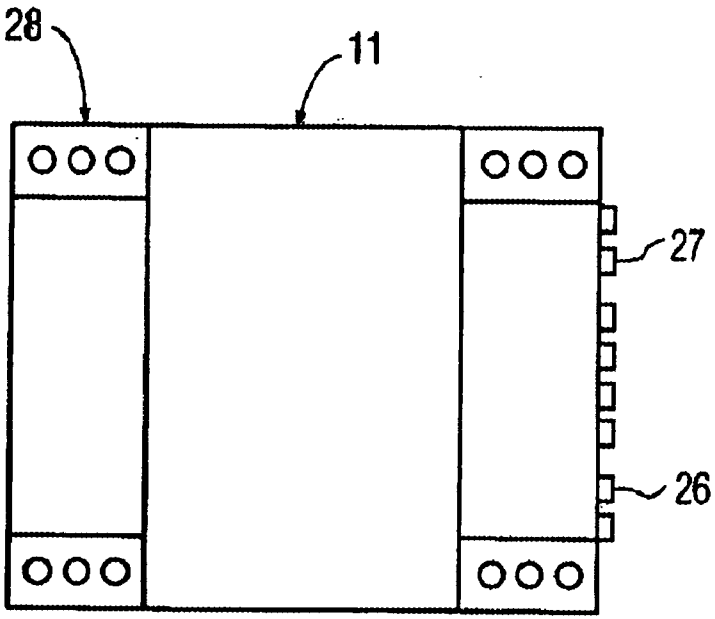
FIG. 1b (PRIOR ART)

Referring now to FIGS. 1*a* through 1*c*, there is illustrated a planar transformer construction 10 of the prior art, including a composite ferrite core made up of a bottom "E" core 11, so named for the E-shape resulting from the upstanding portions 13, 14 and 15 on the base portion 12, and a top "I" core 16, having a planar configuration. Arranged in the spaces between the upstanding portions 13, 14 and 15 is a stack of winding layers 17, 18 and 19, separated by insulating layers 20 through 25, and provided with external connections through lead frames 26 and 27. While only three exemplary winding layers are shown, it will be appreciated that in practice there may be eleven or more such layers, with a corresponding increase in the number of insulating layers. When bonded together in a known manner, these layers form a unitary winding structure 28.

Figure 2A:
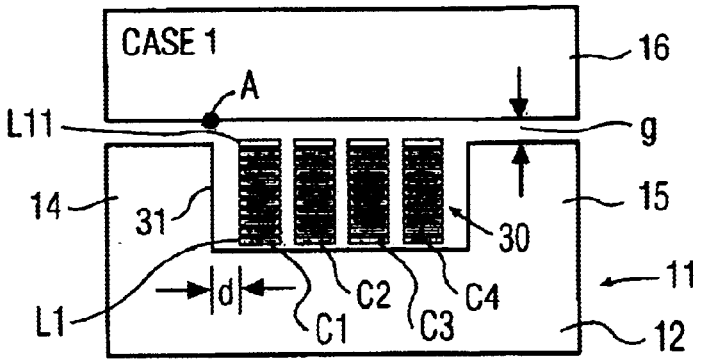
FIGS. 2*a*, 2*b* and 2*c* are side section views of a schematic representation of a planar transformer construction of the type shown in FIG. 1, having a winding configuration of the prior art, a stepped winding configuration of the invention, and a tapered winding configuration of the invention, respectively.
Figure 2B:
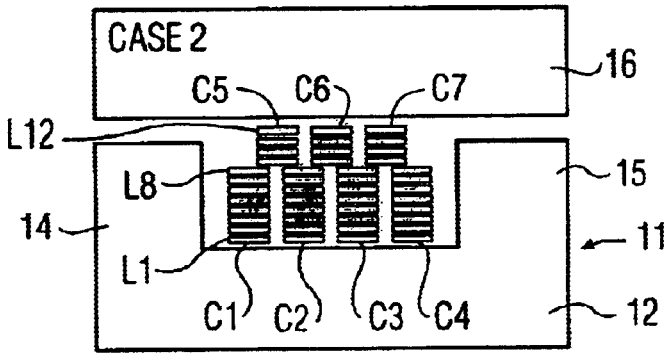
Figure 2C:
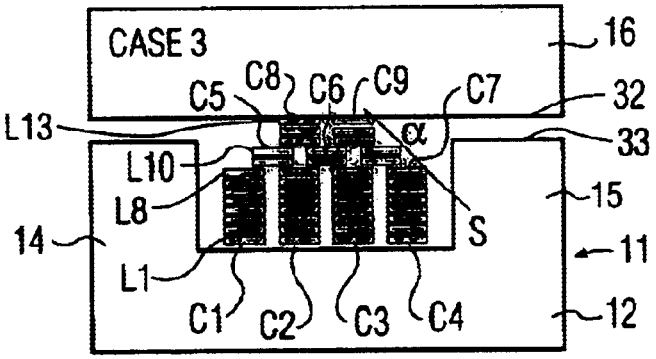

FIGS. 2*a* through 2*c* are cross sectional views of the right half of such a structure, including an upstanding portion 15 and one half of central upstanding portion 14 of E core portion 11, with three different arrangements of the turns in the stacks of winding layers. The construction is assembled so as to result in an air gap between the lower E core portion 11 and upper I core portion 16, the air gap having a height g.

Shown in FIG. 2*a* is a typical winding arrangement of the prior art. A single stack 30 of eleven winding layers L1 through L11 is arranged in the space between the upstanding portions 14 and 15 of core portion 11, each layer having four turns vertically aligned with the turns in the other layers to result in four columns of turns C1 through C4, for a total of 44 turns. Such an arrangement has been found to result in significant losses due to fringing fields in the area of the turns adjacent to the air gap.

In accordance with the invention, it has been found that such losses may be significantly reduced by arranging the winding pattern so that the edges of the windings are at least a distance 2g, and preferably a distance 3g, from point A in the lower surface of the I core 16. directly above the inner surface 31 of upstanding wall 14. This distance defines a "keep away" region which, when kept clear of windings in accordance with the teachings of the invention, has been found to reduce high frequency losses by up to 30 percent, without significantly increasing low frequency losses.

One such arrangement for reducing such high frequency losses is shown in FIG. 2*b*. Stack 30 is composed of two sub-stacks, a lower sub-stack I and an upper sub-stack II. As in FIG. 2*a*, sub-stack I is composed of four columns C1 through C4 of turns. However, the columns are formed of eight layers L1 through L8. The upper sub-stack has three columns C5 through C7 of four layers L9 through L12. Thus, this arrangement also has a total of 44 turns. However, the upper sub-stack is arranged centered over the lower sub-stack, resulting in a stepped arrangement, in which the edges of the upper turns do not extend into the "keep away" region.

Another such arrangement for reducing such high frequency losses is shown in FIG. 2*c*. Stack 30 is composed of three sub-stacks, a lower sub-stack I, a middle sub-stack II and an upper sub-stack III. As in FIGS. 2*a* and 2*b*, sub-stack I is composed of four columns C1 through C4 of turns. As in FIG. 2*b*, the columns are formed of eight layers L1 through L8. However, the widths of the outermost turns in layer L8 have been slightly reduced so that their outer edges approximately coincide with a low frequency curved flux line S associated with the gap-forming surfaces 32 and 33, which flux line S passes approximately through the outer edges of the outermost turns of layer L7. The middle sub-stack II has three columns C5 through C7 of two layers L9 and L10. The widths of the outermost turns are also adjusted so that their outer edges fall approximately on line S. The upper sub-stack III has two columns C8 and C9 of three layers L11 through L13. Again, the outer edges of the turns fall approximately on line S, resulting in an inwardly "tapered" arrangement of a total of 44 turns, in which the edges of the upper turns do not extend into the "keep away" region as defined by line S.

All three of the above winding configurations, referred to hereinafter as Cases 1 through 3, were fit into a Philips E18/4/10 planar EI core, and were compared using a 2D finite element analysis. The air gap, as well as the spacing d between the inner surfaces 31 of the upstanding core portions and the outermost turns of the stack in case 1 and the lower sub-stack I in cases 2 and 3, were kept constant, at 0.5 mm and 0.5 mm, respectively. The smallest distance between the turn edges and point A was 0.5 mm for case 1, 1.0 mm or 2g for case 2 and 1.5 mm or 3g for case 3. The loss densities per meter were computed along the Z axis at 120 Hz (DC loss) and 200 kHz (AC loss). The results are given in the table below.

| | winding loss (W/m) | winding loss (W/m) | winding loss (W/m) |
|---|---|---|---|
| frequency (Hz) | case 1 | case 2 | case 3 |
| 120 | 5.5 | 5.5 | 5.4 |
| 200 k | 94.2 | 73.2 | 68 |
| AC/DC ratio | 17.1 | 13.3 | 12.6 |

As may be seen from the table, AC loss in cases 2 and 3 are only 78 percent and 72 percent, respectively, of case 1, while DC loss remains approximately the same.

Figure 3:
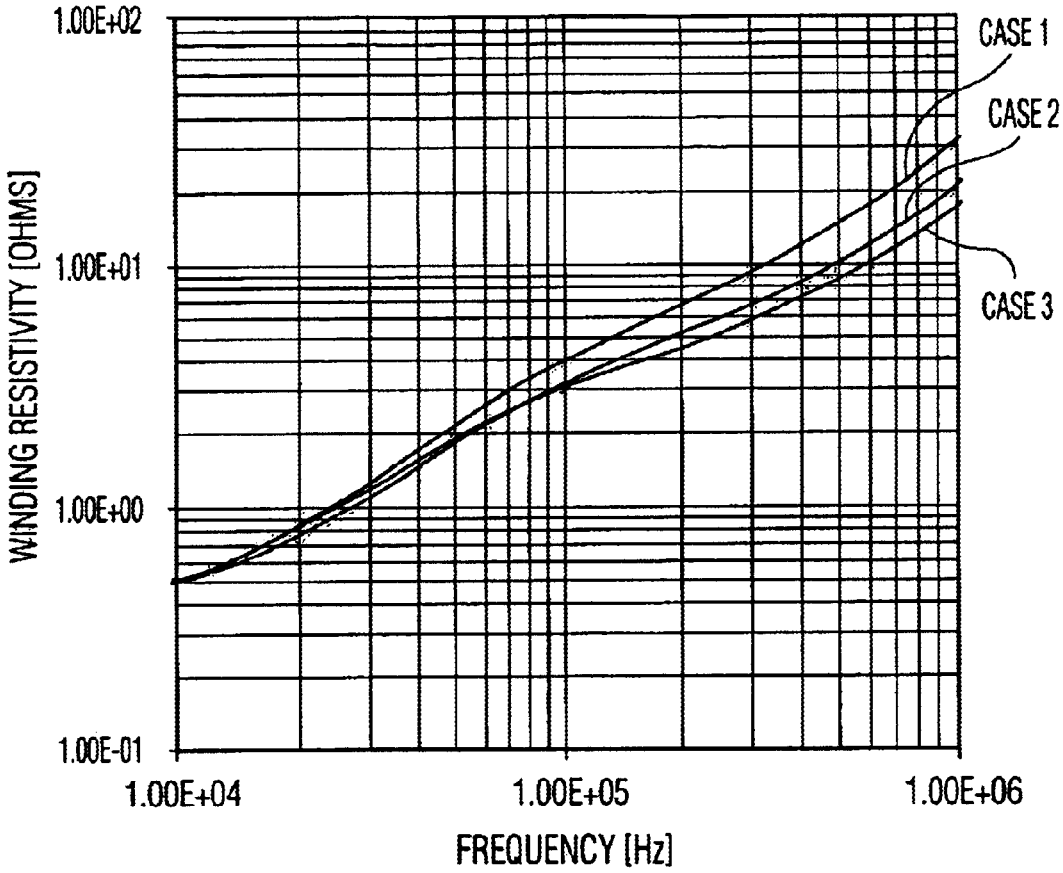
FIG. 3 is a graph of planar inductor winding resistivity in ohms versus frequency in Hz for the planar transformer constructions of FIGS. 2*a* through 2*c*.

FIG. 3 illustrates graphically the winding losses in terms of winding resistivity in ohms as a function of the applied excitation frequency in Hz, in accordance with the above 2D FEA modeling experiment. As may be seen, the losses increase gradually with increasing frequency, but at different rates, case 2 exhibiting a lower growth rate than case 1 and case 3 exhibiting the lowest growth rate.

Figure 4:
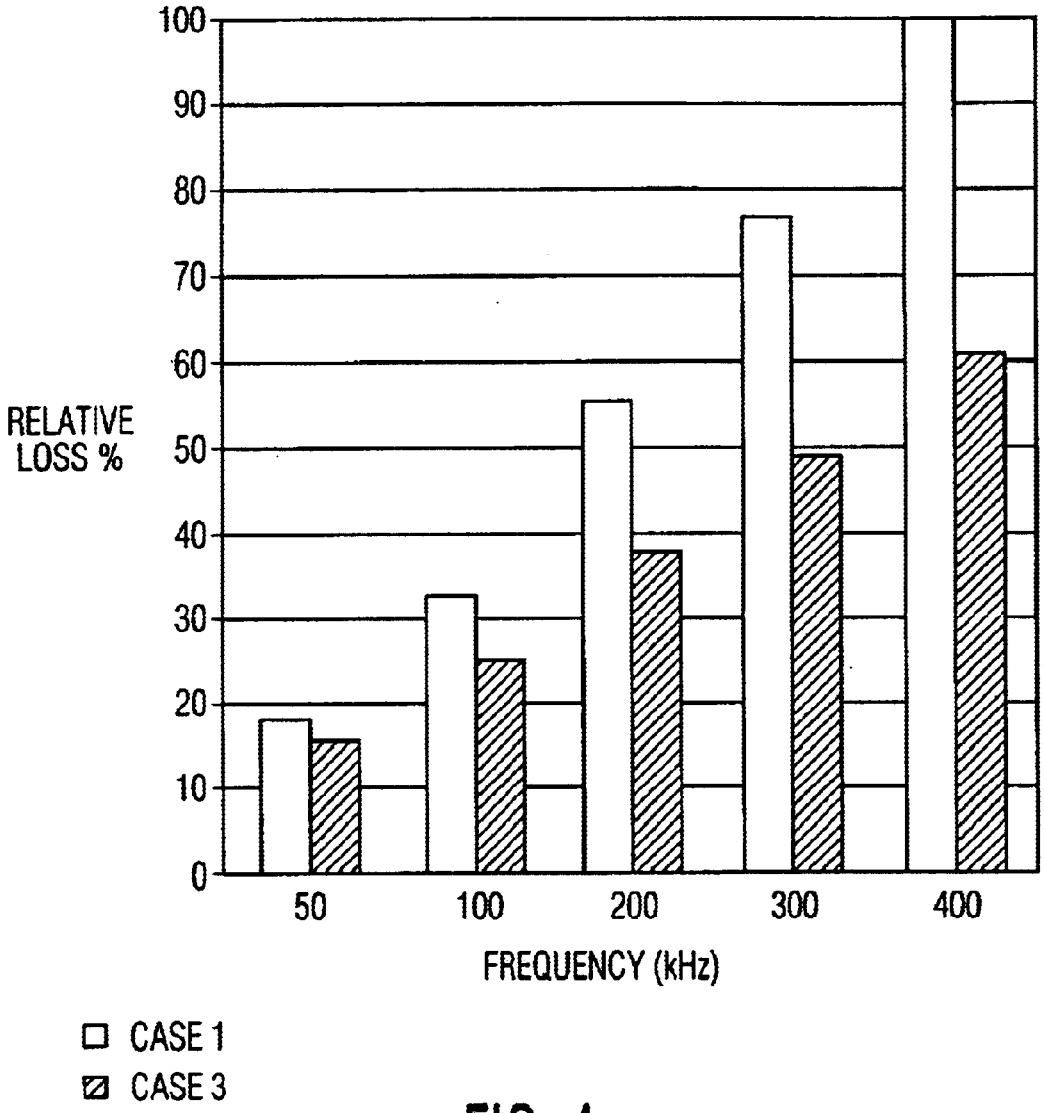

FIG. 4 presents the same data in bar graph form, but only for Cases 1 and 3, and only for the frequencies appropriate for switched mode power supplies or miniaturized electronic ballasts, the applications of greatest interest at the present time. From the graph, it can be seen that in this frequency range, the differences in loss are significant. For example, at 250 kHz, Case 3 has a 35 percent lower winding loss than Case 1. At higher frequencies, this difference is even greater.

Thus, it can be seen that maintaining a "keep away" region of at least 2g can significantly reduce high frequency losses without appreciably increasing low frequency losses, while optimal arrangement of the windings can result in even further reductions in high frequency losses.

The invention has been necessarily described in terms of a limited number of embodiments and variations of embodiments. Other embodiments and variations of embodiments will become apparent to those skilled in the art, and are intended to be encompassed within the scope of the appended claims. For example, other core configurations are possible, such as two U-shaped cores in which the gaps are located adjacent the middle of the winding. More advantageous would be configurations having multiple gaps, such as a core having upper and lower planar core portions and two or more upstanding portions, each upstanding portion forming gaps with the uppper and lower planar core portions. With gaps at both the upper and lower ends of the winding, the height g of each gap can be half that in the E core configuration, reducing the reach of the low frequency flux lines of the fringing fields by the square root of g. Further numbers of gaps would enable further reductions.

As used herein, terms such as "upper", "lower", "upstanding", "vertical" and "horizontal", are used to indicate the relative locations of the various elements in the conventional orientation shown in the drawings, but do not in any way limit the use of the various constructions of the invention to such illustrated orientation.

What we claim as our invention is:

1. A planar magnetic winding structure comprising a core and a stack of winding layers including one or more turns, the core comprised of two or more core components having mutually facing planar surfaces separated by at least one air gap g, and all surfaces of the winding layers are separated from the air gap by a distance of at least 2 g.

2. The planar magnetic winding structure of claim 1 in which all surfaces of the winding layers are separated from the air gap by a distance of at least 3 g.

3. The planar magnetic winding structure of claim 1 in which the core comprises a first lower core component having a planar portion and two or more spaced-apart upstanding portions having planar upper surfaces, the upstanding portions defining a space to accommodate the stack of winding layers, the core also comprising a second upper core component having a planar lower surface, the planar upper surfaces of the upstanding portions of the first core component and the planar lower surface of the second core component defining the air gap g.

4. The planar magnetic structure of claim 3 in which the stack of winding layers in the space between the upstanding portions of the lower core component comprises two or more sub-stacks, each sub-stack having the same number of turns in each layer, the sub-stacks proximal to the air gap g having a smaller number of turns per layer than the sub-stacks distal from the air gap g.

5. The planar magnetic structure of claim 4 in which the number of turns per layer in each successive sub-stack from the most distal sub-stack to the most proximal sub-stack is smaller than the number of turns per layer in the preceding sub-stack.

6. The planar magnetic structure of claim 5 in which there are three sub-stacks, a first lower sub-stack having n turns per layer, a second middle sub-stack having n−1 turns per layer, and a third upper sub-stack having n−2 turns per layer.

7. The planar magnetic structure of claim 6 in which n is 4.

8. The planar magnetic structure of claim 7 in which the first sub-stack has 8 layers, the second sub-stack has 2 layers, and the third sub-stack has 3 layers.

9. The planar magnetic structure of claim 4 in which there are two sub-stacks, a first lower substack having n turns per layer, and a second upper sub-stack having n−1 turns per layer.

10. The planar magnetic structure of claim 9 in which n is 4.

11. The planar magnetic structure of claim 10 in which the first sub-stack has 8 layers and the second sub-stack has 4 layers.

12. The planar magnetic structure of claim 4 in which the total number of turns in the stack is 44.

13. The planar magnetic winding structure of claim 1 in which the number of turns in the winding layers proximal to the gap is less than the number of turns in the winding layers distal to the gap.

* * * * *